United States Patent [19]

McClintock et al.

[11] Patent Number: 5,037,138

[45] Date of Patent: Aug. 6, 1991

[54] PACKAGE WITH SNAP-CLOSURE MECHANISM

[75] Inventors: Jack M. McClintock, Pittsburgh, Pa.; Lloyd Kovacs, Sheboygan, Wis.; Mohanlal S. Nerurkar; Kevin Nelson, both of Appleton, Wis.

[73] Assignee: Morgan Adhesives Company, Stow, Ohio

[21] Appl. No.: 454,437

[22] Filed: Dec. 21, 1989

[51] Int. Cl.[5] ..... B65D 33/24; B65D 33/30

[52] U.S. Cl. ..... 383/34; 206/632; 383/43; 383/61

[58] Field of Search ..... 383/34, 34.1, 43, 61; 206/632

[56] References Cited

U.S. PATENT DOCUMENTS

| | | | |
|---|---|---|---|
| 488,783 | 12/1892 | Weber | 383/43 |
| 1,798,945 | 3/1931 | Lamarthe | 383/43 |
| 2,635,788 | 4/1953 | Snyder et al. | 383/61 |
| 2,815,150 | 12/1957 | Herzig | 383/43 |
| 4,317,478 | 3/1982 | Babbidge | 383/43 |
| 4,356,954 | 11/1982 | Mojonnier | 383/61 |
| 4,593,408 | 6/1986 | Drobish et al. | 383/43 |
| 4,898,280 | 2/1990 | Runge | 383/61 |

*Primary Examiner*—Stephen P. Garbe

*Attorney, Agent, or Firm*—Lee, Mann, Smith, McWilliams & Sweeney

[57] ABSTRACT

A reclosable package for containing and protecting product disposed therein including an initial seal and a releasable snap-closure mechanism adapted to maintain a tight closure between the product and the environment after the initial seal is broken, the snap-closure mechanism adapted to be snapped open and remain in the open position without the application of pressure so that the product may be easily dispensed therefrom and, when pressure is applied, to snap back to the closed position.

10 Claims, 2 Drawing Sheets

PACKAGE WITH SNAP-CLOSURE MECHANISM

BACKGROUND OF THE INVENTION

The present invention is directed to a package or bag with a snap-closure mechanism. More specifically, it is directed to a bag with a closure arrangement which will remain in its opened position once opened without the application of pressure and when acted upon will snap shut to maintain a tight closure between the product and the environment. Numerous arrangements of this general type are shown in the prior art U.S. Pat. Nos. 355,010, 2,093,476, 2,714,911, 2,720,903, 2,822,012, 3,163,193, 3,272,248, 3,366,312, 3,578,236 3,782,601, 3,977,450, 4,027,819, 4,611,715 and 4,679,701. None of these arrangements discloses the features of the present device.

SUMMARY OF THE INVENTION

The present invention provides a package with an initial seal and a snap closure mechanism to contain and protect product disposed therein after the initial seal is broken. The closure mechanism includes a semi-rigid plastic strip which extends across the width of the package and is secured thereto. The strip is hinged so as to be movable between a closed position and an opened position. When the strip is in the closed position, the package is sealed to prevent product from being dispensed therefrom. When the strip is moved to the opened position, product may be freely and easily dispensed from the package. The strip remains in the opened position without the application of pressure until manually returned to the closed position.

DETAILED DESCRIPTION OF THE INVENTION

Figure 1:
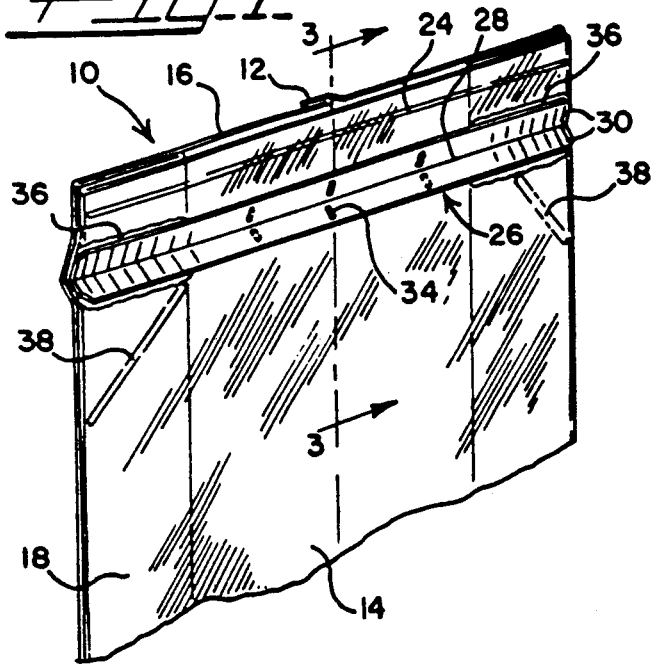
FIG. 1 shows a perspective view of a package with the closure mechanism of the present invention in a sealed position.
Figure 2:
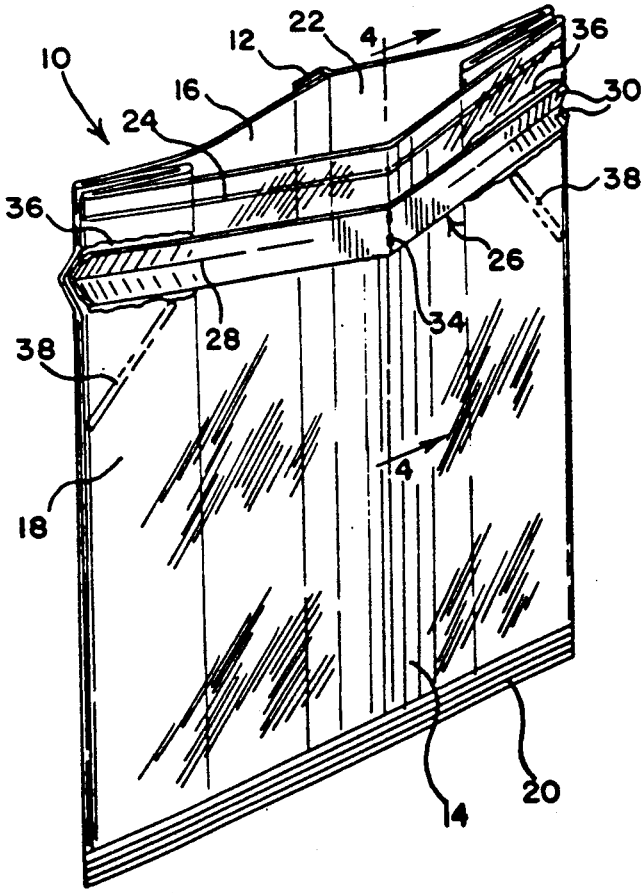
FIG. 2 shows a perspective view of a package with the closure mechanism of the present invention in an opened position.
Figure 4:
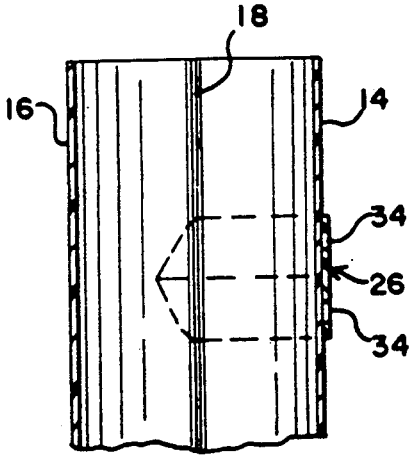
FIG. 4 is a cross-sectional view of FIG. 2 taken along the line 4—4 shown in FIG. 2.

A reclosable package for containing and protecting product therein is shown in FIGS. 1 and 2 of the drawings and is generally designated by the numeral 10. The package 10 may be formed from a single sheet comprised of multiple layers of coextruded materials or may be formed from two sheets which are sealed together around the perimeter. A package material that has been found to work well is a coextrusion having an outer layer of high density polyethylene and an inner layer of low density ethylene vinyl acetate copolymer. If a single sheet is used to form the package, opposing ends of the coextruded sheet are joined together at the back and sealed to form what is commonly referred to as a fin seal 12. The package includes a front wall 14, a rear wall 16 and a pair of side edges 18. The sides 18 of the package are folded inwardly in the preferred embodiment to define gussets and the lower portion of the package is provided with a crimp seal 20. An opening 22 is initially provided at the upper portion of the package 10 to permit the ingress and egress of a dry food product, as cereal, potato chips, etc.

The package 10, after it is filled with product, is provided with a heat seal 24 which forms a primary closure. The heat seal 24 extends longitudinally across the upper portion of the package 10. A reusable secondary -snap-closure mechanism, generally indicated by the numeral 26, is provided between the primary closure 24 and the product disposed within the package 10.

Figure 3:
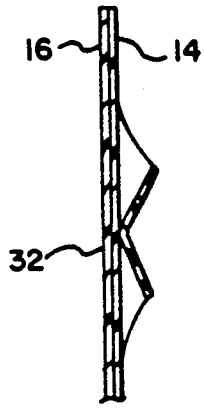
FIG. 3 is a cross-sectional view of FIG. 1 taken along the line 3—3 shown in FIG. 1.

The closure mechanism 26 includes a flexible, semi-rigid plastic strip which is deformable by means of a hinge arrangement between an opened position, as seen in FIG. 2, and a closed position, as seen in FIG. 1. The strip 26 of the preferred embodiment is approximately 14 mils thick. The length and width of the strip 26 vary with the size of the package 10, but it is preferred in this embodiment that the strip be slightly longer than the width of the bag. It has been found that a plastic which works well is biaxially oriented polyethylene terephthalate of the type sold by DuPont under the trademark MYLAR and sold by CIC under the trademark MELINEX. Other resilient, semi-rigid materials having similar properties may be used as well. The ends of the strip 26 are fixed to the front wall 14 over the respective gussets 18 and sealed thereto by means of a hot melt adhesive, such as ethylene vinyl acetate copolymer, or other suitable means, as pressure sensitive adhesive. In other embodiments, described below wherein the strip 26 is disposed inside the package and adjacent the inner surface of the front wall 14, the entire length of the strip 26 may be fixed to the front wall 14. One embodiment of the strip 26 defines a horizontally-disposed central crease 28 having a pair of walls 30 extending outwardly therefrom at an angle to the plane of the front wall 14. The crease 28 increases the rigidity of the strip 26. As best seen in FIG. 3, the central crease 28 defines an abutment surface 32 which abuts the outer surface of the front wall 14 and holds the front wall 14 against the rear wall 16 when the strip 26 is the closed position. It is contemplated that various other configurations may be used for the strip 26 as long as an abutment surface is provided including a strip which is bowed in an arcuate shape about its longitudinal axis.

It is contemplated that in addition to the first strip 26 disposed adjacent the outer surface of the front wall 14, as shown in FIGS. 1 and 2, a second strip, not shown, can be disposed adjacent the outer surface of the rear package wall 16 so that the respective abutment surfaces hold the walls 14 and 16 into tighter sealing engagement with one another when the two strips 26 are in the closed position. Additionally, it is contemplated that a strip 26 may be disposed adjacent the inner surface of one or the other or both of the package walls 14 and 16. The last arrangement is illustrated in cross-section in FIG. 6.

As seen in FIGS. 7(*a*)–7(*d*), when the strips 26 are provided on opposing inner surfaces of the package walls, one strip may be provided with projections 33 and the opposing strip may be provided with corresponding indentations 35. The projections 33 and indentations 35 may take a variety of shapes, as illustrated. The projections 33 are adapted for releasable engagement with the indentations 35 to provide an interlocking mechanism to ensure a more positive seal.

Figure 5:
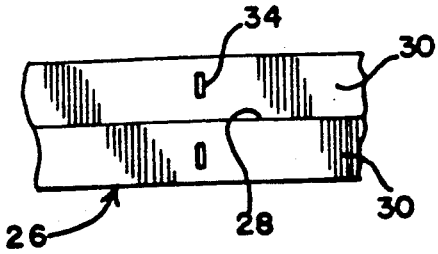
FIG. 5 is a partial front view of the resilient strip of the closure mechanism of the present invention showing the deformations at the predetermined hinge point of the mechanism.

A hinge mechanism is built into the strip 26, so that it is bendable at a predetermined hinge point which, in the preferred embodiment is along the central vertical axis of the strip 26. As shown in phantom in FIG. 1, more than one hinge point may be provided, as at the vertical axes at $\frac{1}{3}$ and $\frac{2}{3}$ the length of the strip 26. As best shown in FIG. 5, the hinge arrangement consists of a pair of vertical slits 34 formed in the strip 26, one disposed above the crease 28 and the other disposed below the crease 28. The slits 34 weaken the resistance of the strip 26 to bending in a direction perpendicular the longitudinal axis thereof. This permits the package 10 to be opened wider and to remain in the opened position, without the further application of force. While vertical slits 34 are shown, other geometric configurations of hinge arrangements may be used as well, as horizontal slits or circular apertures.

A heat seal 36 is shown in FIG. 1, extending across the width of the gussets 18 above each end of the strip 26 to seal the gussets 18. Beneath each end of the closure strip 26 is provided a diagonal heat seal 38. The heat seal 38 extends from the inner wall of each gusset 18 to the outer wall thereof. These seals 38 form a channel and provide for improved flow of the product from the package 10.

The operation of the closure mechanism 26 will now be described. When the consumer purchases the product, both the primary seal 24 and the secondary closure 26 are sealed to protect the product within the package 10. In order to open the package 10, the user grips the upper portions of the front and rear walls 14 and 16 of the package 10 and pulls outwardly, thereby breaking the primary seal 24. The strip 26 by virtue of its structure and configuration is normally biased to the closed position. As the user continues to pull and exerts a force greater than the biasing force, the strip 26 snaps open at the hinge point to the position illustrated in FIG. 2. The strip 26, without the application of additional force, will remain biased to the opened position permitting the product to be dispensed freely from the package 10 until pressure is manually applied. When a force is applied to the strip 26 in the direction of the wall 16, the strip 26 snaps back to the closed position shown in FIG. 1, whereby the abutment surface 32 urges the front wall 14 against the rear wall 16 to thereby prevent inadvertent spillage of the product from the package 10 and to seal the package 10 to maintain quality and freshness of the product.

Figure 6:
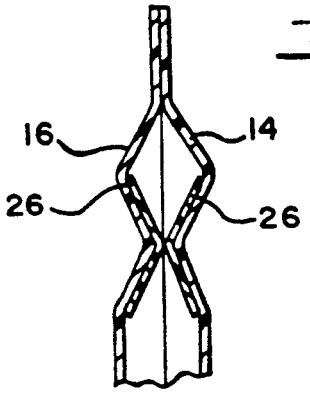
FIG. 6 shows a cross-sectional view of an alternate embodiment of a closure mechanism wherein cooperating strips are positioned on the inner surfaces of opposing package walls.
Figure 7A:
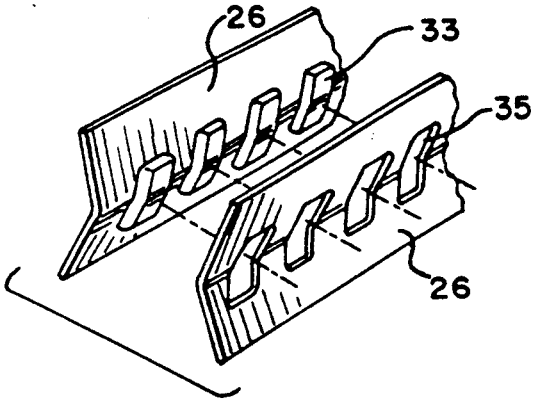
FIGS. 7(*a*)–7(*d*) show various partial views of interconnecting projection-indentation arrangements which may be provided on the closure mechanism of the present invention.
Figure 7C:
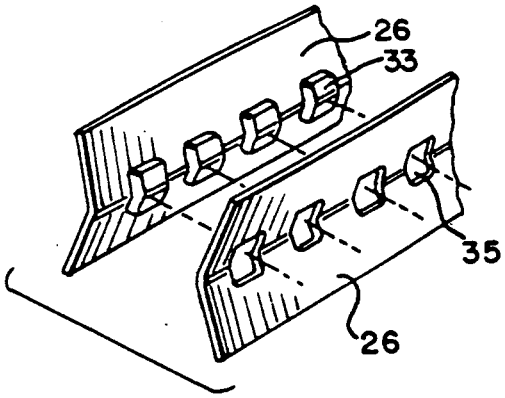
Figure 7B:
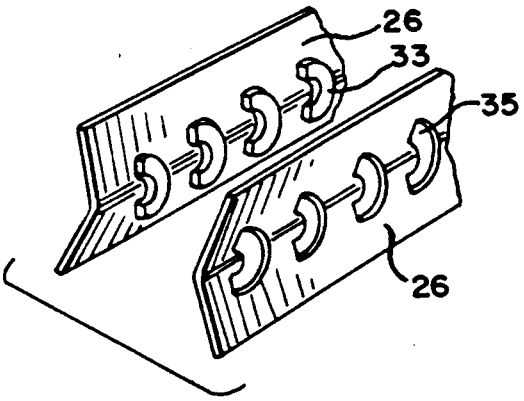
Figure 7D:
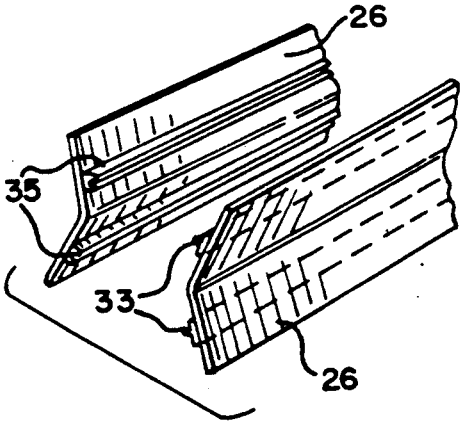

Closure mechanism arrangements having two strips, one disposed adjacent the outer surface of each package wall 14, 16, operate in a like manner. Closure mechanism arrangements having one strip disposed adjacent the inner surface of one of the package walls 14 or 16 or having one strip disposed adjacent the inner surface of each package wall 14, 16, as illustrated in FIG. 6, operate in a slightly different manner. Since, for example in the single strip arrangement, the strip 26 is disposed inside the package and adjacent an inner surface of the package wall 14, the abutment surface 32 of the strip 26 does not urge the front package wall 14 into engagement with the rear package wall 16, but rather the abutment surface 32 directly abuts the rear package wall 16 to provide a tight closure of the package 10. In the same type of arrangement incorporating two strips 26, instead of one, the abutment surfaces contact one another to provide the closure.

The above-described closure mechanism is inexpensive to manufacture and may be quickly and easily opened and closed and will maintain the position selected by the consumer. Thus it has been shown that the present invention provides an inexpensive, easily operable snap-closure mechanism for a package.

Various features of the invention have been particularly shown and described in connection with the illustrated embodiments of the invention, however, it must be understood that these particular arrangements and methods merely illustrate and that the invention is to be given its fullest interpretation within the terms of the appended claims.

What is claimed is:

1. A reclosable package including first and second package walls sealable about their perimeters to effect a closed package for containing product therein; and a reclosable snap closure mechanism operable after said package is opened to effect a secondary closure of said package, said snap-closure mechanism including a first flexible, semi-rigid strip extending substantially across the width of said package and positioned adjacent thereto, said strip fastened at both ends thereof to said first package wall, said strip normally biased to urge said first and second package walls together in a closed position to effect a seal therebetween; a diagonal seal connecting said first and second package walls together, said seal positioned below said strip and extending between said strip and a side edge of said package to form a channel for directing product toward the center of said package when pouring contents therefrom; and hinge means associated with said strip intermediate the ends thereof operable, upon the application of an opening focus, to allow said first and second package walls to be separated and remain separated from each other to form an opening for insertion or removal of product from said package; whereby said strip and said hinge means are constructed such that said package will remain biased to said closed position until a separating force, greater than said biasing force is exerted to move said strip from said closed position to said opened position and such that said strip will then remain in said opened position without further application of force until a closing force is exerted causing said strip to snap-back to said closed position.

2. A reclosable package as in claim 1 in which said hinge means consists of one or more slits formed in said strip to weaken the resistance of said strip to bending in a direction perpendicular to the longitudinal axis thereof.

3. A reclosable package as in claim 1 in which said hinge means consists of one or more apertures formed in said strip to weaken the resistance of said strip to bending in a direction perpendicular to the longitudinal axis thereof.

4. A reclosable package as in claim 1 in which said flexible, semi-rigid strip is bowed about its longitudinal axis to form an abutment surface and a channel, said abutment surface positioned adjacent and in contact with one of said package walls substantially along the width thereof when said package is in said closed position.

5. A reclosable package as in claim 1 in which said flexible, semi-rigid strip defines a crease along its longitudinal axis and has a pair of walls extending angularly outwardly therefrom, said crease defining said abutment surface.

6. A reclosable package as in claim 1 including a second flexible, semi-rigid strip extending substantially across the width of said package and positioned adjacent thereto, said second strip fastened to said second package wall, said second strip normally biased to urge said first and second package walls together in a closed position to effect a seal therebetween.

7. A reclosable package as in claim 6 wherein said strips are positioned inside of said package and adjacent the respective interior surfaces of said first and second package walls.

8. A reclosable package as in claim 7 including a plurality of projections formed along the interior surface of one of said strips and a plurality of corresponding indentations formed along the interior surface of the other of said strips, said projections adapted for releasable engagement with said indentations to form a tight seal between said strips.

9. A reclosable package as in claim 1 including a pair of said diagonal seals, one extending from each side edge of said package toward said strip.

10. A reclosable package as in claim 1 including a pair of horizontal seals connecting said first and second package walls together, each horizontal seal positioned above said strip and extending inwardly from an opposing side edge of said package.

* * * * *